US008241077B2

(12) United States Patent
Suzuki et al.

(10) Patent No.: US 8,241,077 B2
(45) Date of Patent: Aug. 14, 2012

(54) TERMINAL FITTING

(75) Inventors: Masakazu Suzuki, Yokkaichi (JP); Yasuaki Nakayama, Yokkaichi (JP); Yohei Kugumiya, Wako (JP); Kazuyuki Iwashita, Wako (JP); Hirotomi Nemoto, Wako (JP)

(73) Assignees: Sumitomo Wiring Systems, Ltd. (JP); Honda Motor Co., Ltd. (JP)

( * ) Notice: Subject to any disclaimer, the term of this patent is extended or adjusted under 35 U.S.C. 154(b) by 0 days.

(21) Appl. No.: 13/037,486

(22) Filed: Mar. 1, 2011

(65) Prior Publication Data

US 2011/0212656 A1 Sep. 1, 2011

(30) Foreign Application Priority Data

Mar. 1, 2010 (JP) ..... 2010-044178

(51) Int. Cl.
*H01R 11/11* (2006.01)

(52) U.S. Cl. ..... 439/852; 439/839

(58) Field of Classification Search ..... 439/852, 439/851, 839

See application file for complete search history.

(56) References Cited

U.S. PATENT DOCUMENTS

| | | | | |
|---|---|---|---|---|
| 7,513,806 | B2 * | 4/2009 | Noda et al. | 439/852 |
| 7,938,695 | B2 * | 5/2011 | Furutani et al. | 439/852 |
| 2001/0051472 | A1 | 12/2001 | Sato et al. | |
| 2004/0192119 | A1 | 9/2004 | Sakurai et al. | |
| 2007/0218733 | A1 | 9/2007 | Philipp | |
| 2010/0173539 | A1 | 7/2010 | Furutani et al. | |

FOREIGN PATENT DOCUMENTS

| | | |
|---|---|---|
| JP | 3126370 | 4/1990 |
| JP | 2007-179747 | 7/2007 |

* cited by examiner

*Primary Examiner* — Gary F. Paumen

(74) *Attorney, Agent, or Firm* — Gerald E. Hespos; Michael J. Porco

(57) ABSTRACT

A terminal fitting includes: a body portion having a space for inserting a tab of a mating terminal therein; an elastic contact piece provided to face the space, having a configuration as to be extended like a cantilever in a direction of an insertion and pull-out of the tab with respect to the space through a wall-shaped portion constituting the body portion, and having a contact portion to come in contact with the tab; and an elastic reinforcing piece provided on an opposite side to the space with the elastic contact piece interposed therebetween, having a configuration as to be extended like a cantilever in the direction of the insertion and pull-out of the tab from the wall-shaped portion constituting the body portion, and causing an extended end to correspond to a displaced region in an elastic flexure in the elastic contact piece.

9 Claims, 8 Drawing Sheets

TERMINAL FITTING

BACKGROUND OF THE INVENTION

1. Field of the Invention

The present invention relates to a terminal fitting.

2. Description of the Related Art

JP-A-2007-179747 describes a terminal fitting which accommodates an elastic contact piece in a body portion taking substantially square tube shape rod and causes the elastic contact piece to elastically come in contact with a tab of a mating terminal inserted in the body portion. The terminal fitting has a structure in which an elastic reinforcing piece is applied to the elastic contact piece in order to increase a contact pressure between the elastic contact piece and the tab. The structure for thus reinforcing an elastic restoring force of the elastic contact piece with the elastic reinforcing piece to increase the contact pressure is taken as an effective countermeasure in the case in which there is a fear that the elastic restoring force of the elastic contact piece might be decreased with a reduction in a size of the terminal fitting.

In the terminal fitting according to the related art, the elastic contact piece is extended like a cantilever. However, an extended end (a free end) is provided in non-contact with a wall-shaped portion constituting the body portion. For this reason, there is a fear that a sufficient contact pressure might not be obtained even if the elastic contact piece is reinforced with the elastic reinforcing piece.

SUMMARY OF THE INVENTION

An object of the invention is to enable a maintenance of a sufficient contact pressure between a tab and an elastic contact piece also in the case in which a size is reduced.

In order to achieve the object, a first aspect of the invention is directed to a terminal fitting including a body portion taking substantially square tube shape rod and having an inserting space for inserting a tab of a mating terminal therein, an elastic contact piece provided to face the inserting space, having a configuration as to be extended like a cantilever in a direction of an insertion and pull-out of the tab with respect to the inserting space through a wall-shaped portion constituting the body portion, and having a contact portion to come in contact with the tab, and an elastic reinforcing piece provided on an opposite side to the inserting space with the elastic contact piece interposed therebetween, having a configuration as to be extended like a cantilever in the direction of the insertion and pull-out of the tab from the wall-shaped portion constituting the body portion, and causing an extended end to correspond to a displaced region in an elastic flexure in the elastic contact piece, the elastic contact piece being elastically flexed through an abutment of the tab on the contact portion and the elastic reinforcing piece being elastically flexed through an abutment of the elastic contact piece flexed elastically in a state in which the tab is inserted in the inserting space, wherein an extended end of the elastic contact piece is provided in a non-corresponding position to the elastic reinforcing piece in the direction of the insertion and pull-out of the tab, and the extended end of the elastic contact piece abuts on the wall-shaped portion constituting the body portion in a state in which the contact portion abuts on the tab.

A second aspect of the invention is directed to the terminal fitting according to the first aspect of the invention, wherein the elastic contact piece has a configuration as to be extended in an almost identical direction to the direction of the insertion of the tab into the inserting space.

A third aspect of the invention is directed to the terminal fitting according to the first or second aspect of the invention, wherein the extended end of the elastic reinforcing piece is provided in a corresponding position to the contact portion or the vicinity thereof.

A fourth aspect of the invention is directed to the terminal fitting according to any of the first to third aspects of the invention, wherein the body portion has a configuration that a plurality of wall-shaped portions is linked through an almost parallel fold with the direction of the insertion and pull-out of the tab, and the wall-shaped portion is provided with a holding portion for restricting a relative displacement between the wall-shaped portions to hold the shape of the body portion through an engagement with another wall-shaped portion.

A fifth aspect of the invention is directed to the terminal fitting according to the fourth aspect of the invention, wherein a direction of an extension of the elastic contact piece and that of an extension of the elastic reinforcing piece are opposite to each other, the extended end of the elastic contact piece abuts on the wall-shaped portion to which a base end of the elastic reinforcing piece is liked, and the holding portion is formed in the wall-shaped portion to which the base end of the elastic reinforcing piece is linked.

According to the first aspect, in the state in which the tab inserted into the inserting space abuts on the contact portion so that the elastic contact piece is elastically flexed, the extended end of the elastic contact piece abuts on the wall-shaped portion. Therefore, the elastic contact piece is supported on the wall-shaped portion at two points, that is, the base end and the extended end. According to the invention, an elastic restoring force of the elastic contact piece is increased by the configuration in which the elastic contact piece is supported on the two points and the configuration in which the elastic reinforcing piece reinforces the elastic restoring force of the elastic contact piece. Therefore, it is possible to ensure a high contact pressure between the tab and the elastic contact piece.

According to the second aspect, even if an inserting posture of the tab with respect to the inserting space is inclined, there is no fear that the tab might collide with the extended end of the elastic contact piece.

According to the third aspect, when the elastic contact piece is elastically flexed, the extended end of the elastic reinforcing piece abuts on the contact portion or a vicinal position thereof. Therefore, a displacement of the contact portion is stabilized. Consequently, a contact pressure between the elastic contact piece and the tab is also stabilized.

According to the fourth aspect, by the engaging action of the holding portion, the relative displacement between the wall-shaped portions is controlled to hold the shape of the body portion. Therefore, a quantity of an elastic flexure of the elastic contact piece or the elastic reinforcing piece in the insertion of the tab is stabilized so that a contact pressure is also made stable.

According to the fifth aspect, by taking note of the fact that the wall-shaped portion to which the base end of the elastic reinforcing piece is linked is positioned on an external surface side of the elastic contact piece, the holding portion is formed in the wall-shaped portion to which the elastic reinforcing piece is liked. Consequently, both a position of the base end of the elastic reinforcing piece and that of the extended end of the elastic contact piece can be stabilized by the single holding portion.

BRIEF DESCRIPTION OF THE DRAWINGS

The present invention will become more fully understood from the detailed description given hereinbelow and the accompanying drawing which is given by way of illustration only, and thus is not limitative of the present invention.

BRIEF DESCRIPTION OF THE DRAWINGS

Figure 1:
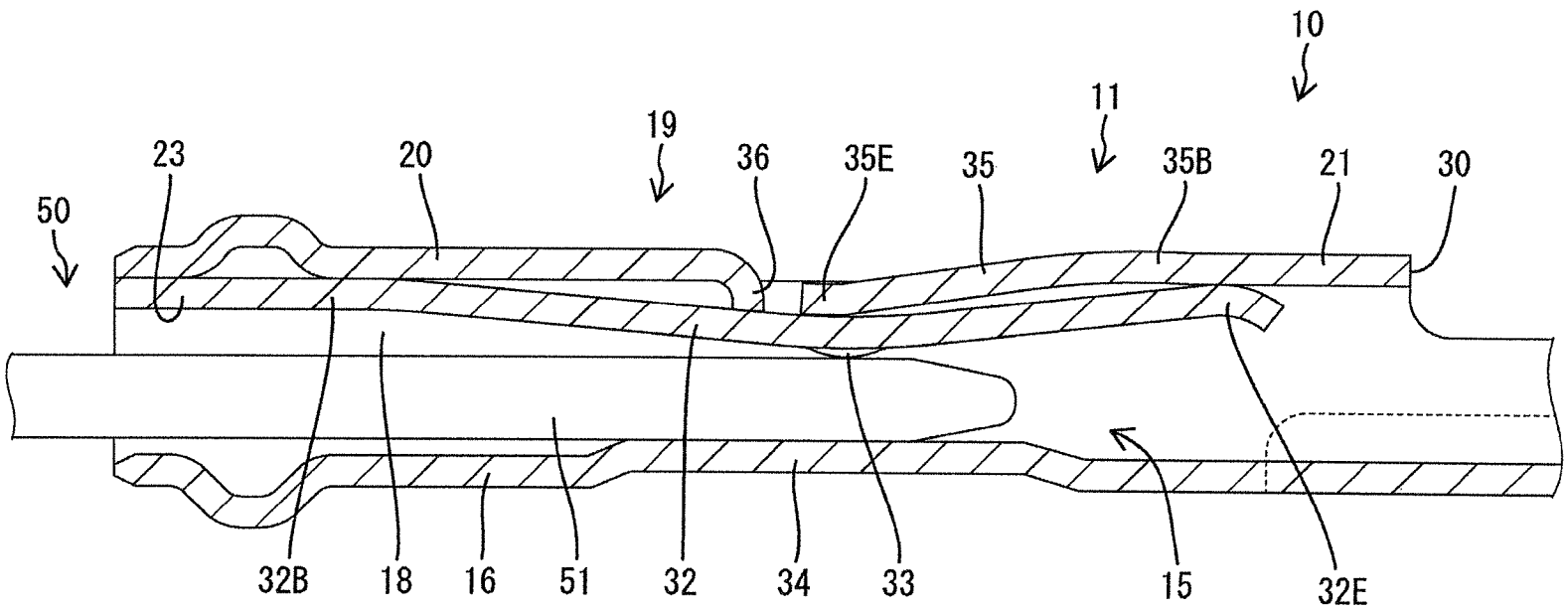

FIG. 1 is a partial enlarged sectional view showing a terminal fitting, illustrating a state in which a tab is inserted therein according to a first embodiment.

Figure 2:
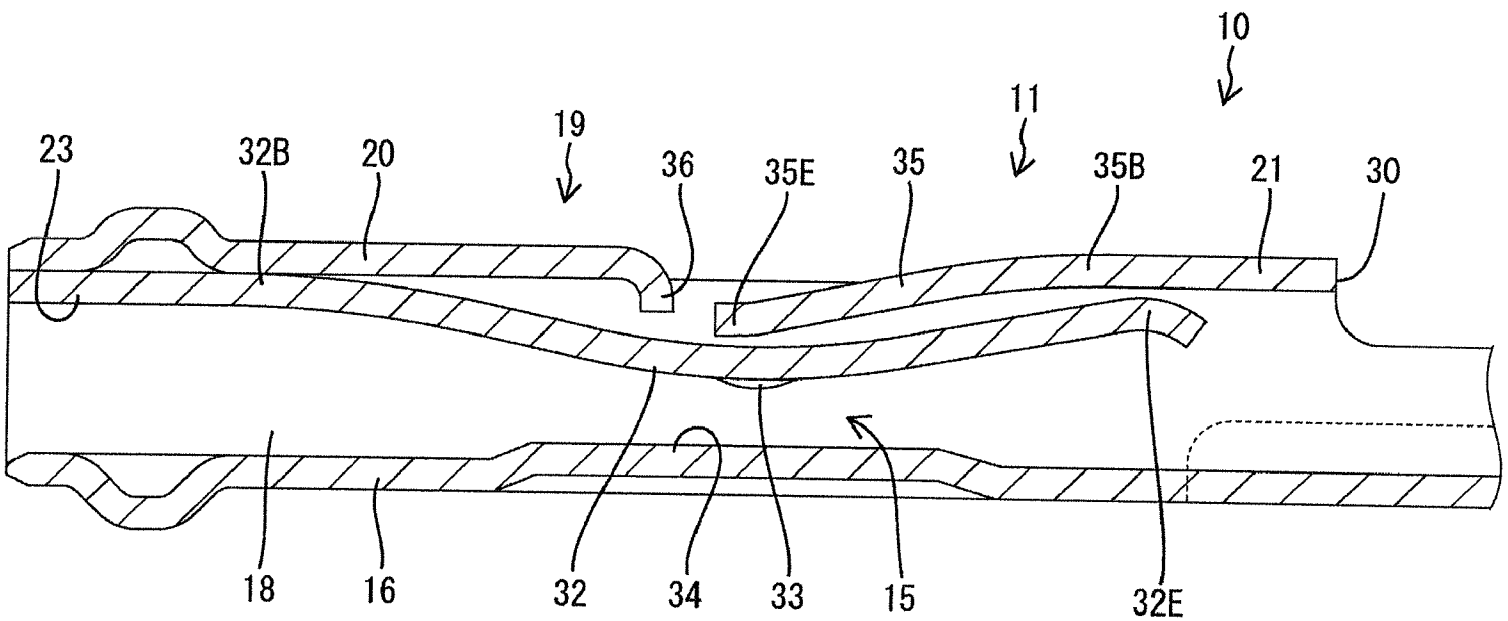

FIG. 2 is a partial enlarged sectional view showing the terminal fitting.

Figure 3:
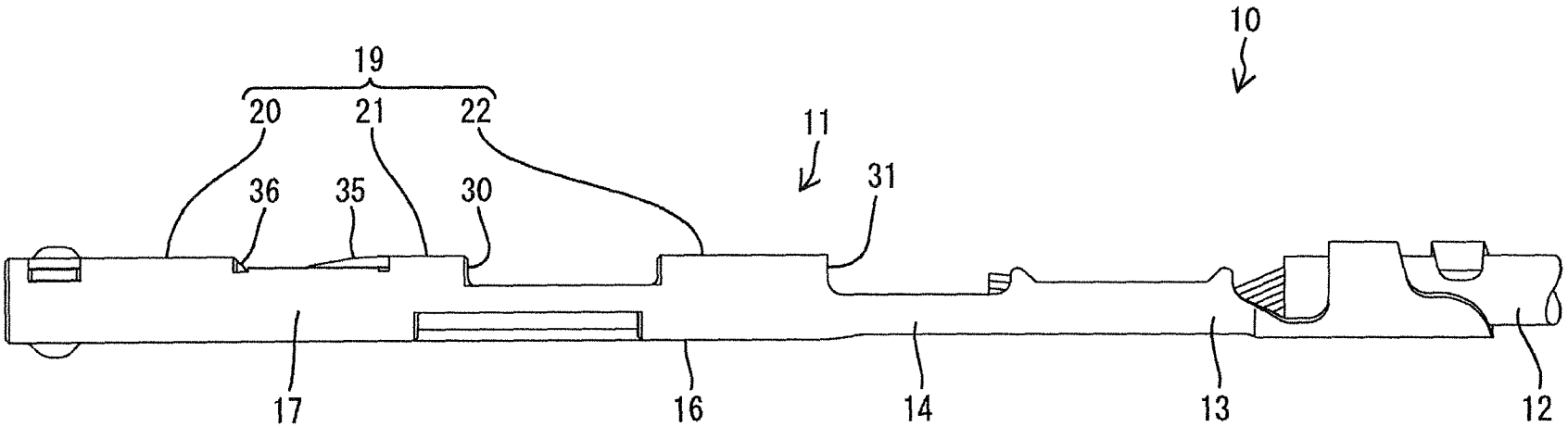

FIG. 3 is a left side view showing the terminal fitting.

Figure 4:
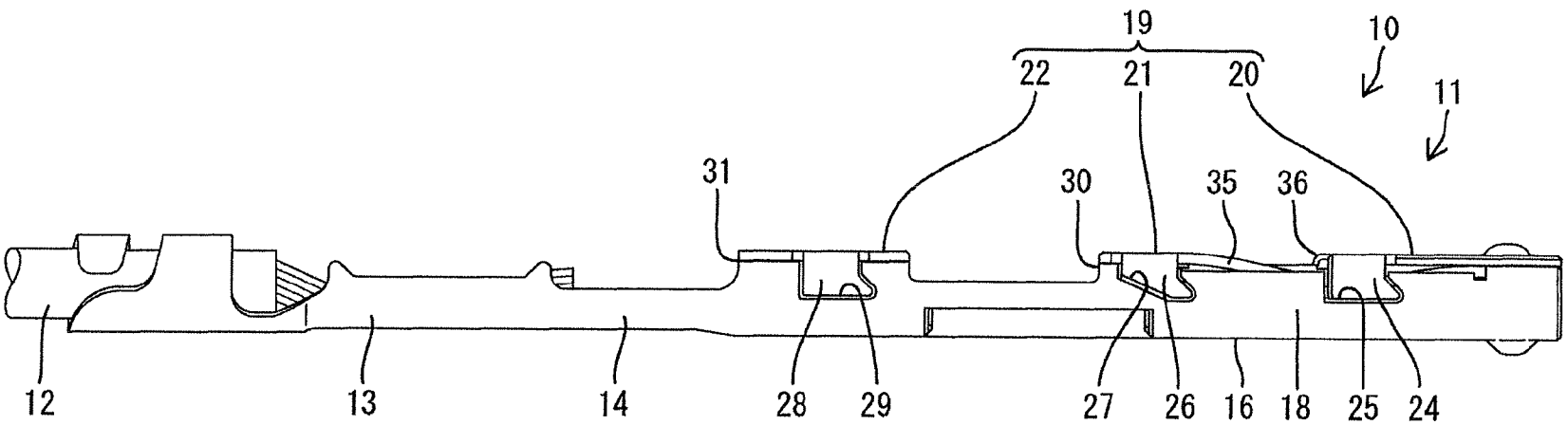

FIG. 4 is a right side view showing the terminal fitting.

Figure 5:
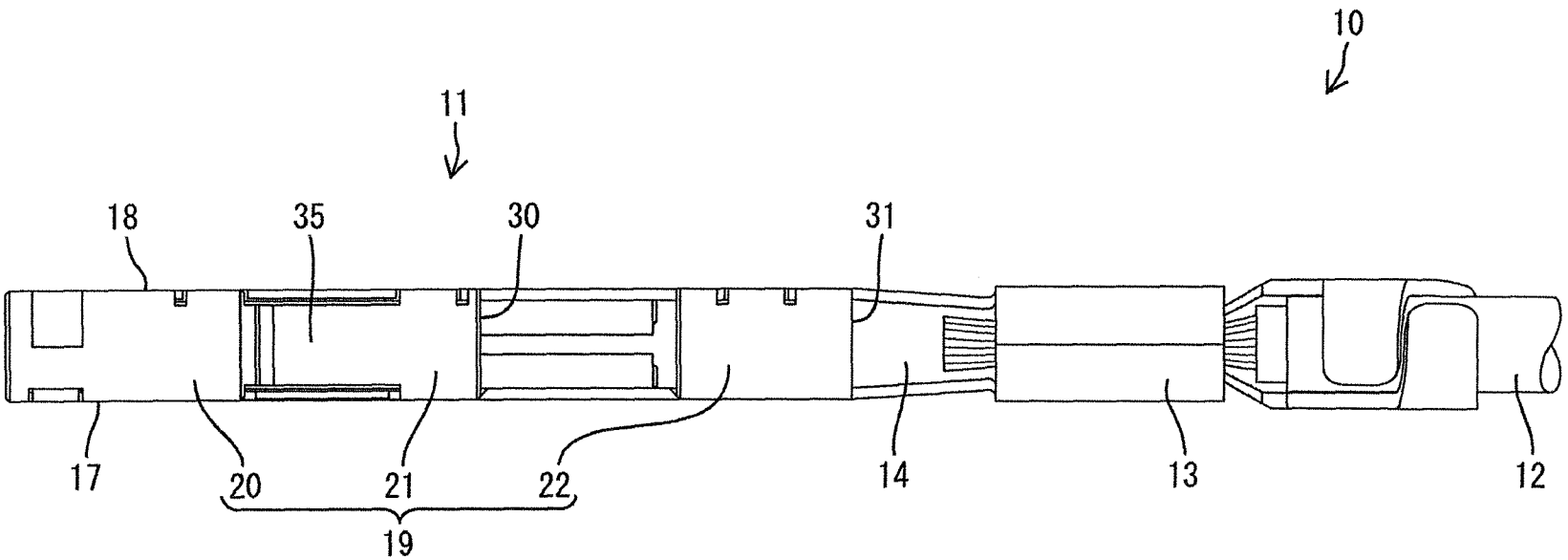

FIG. 5 is a plan view showing the terminal fitting.

Figure 6:
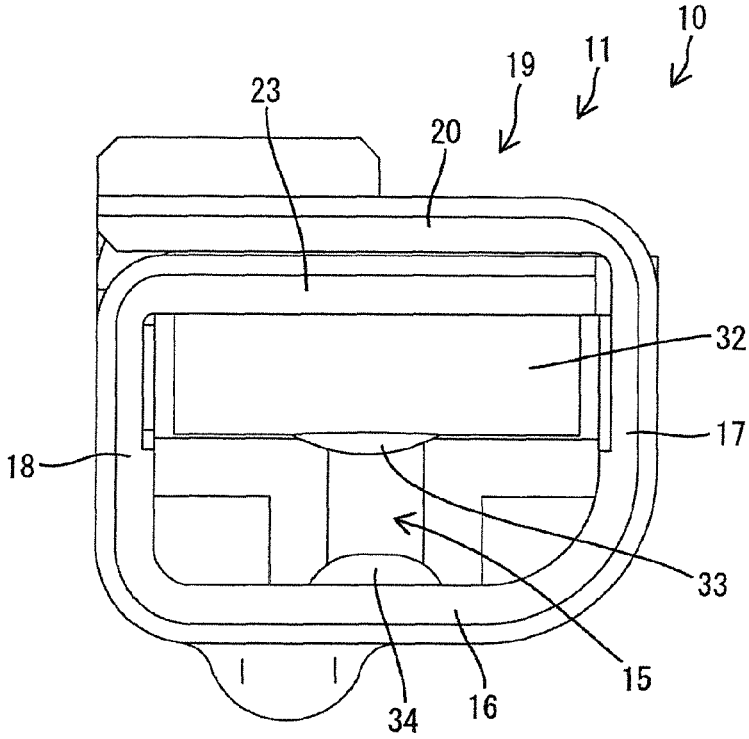

FIG. 6 is a front view showing the terminal fitting in a state in which the tab is inserted therein.

Figure 7:
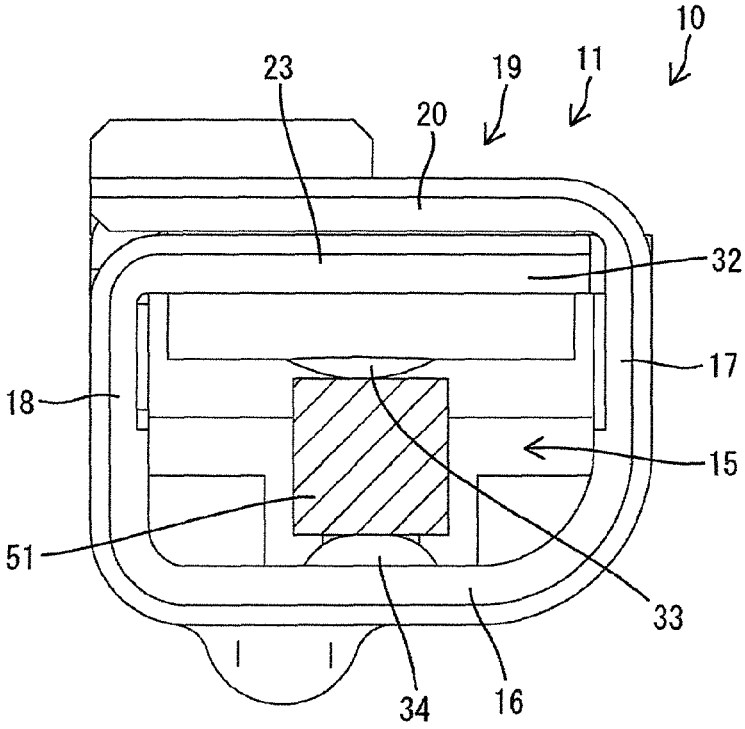

FIG. 7 is a front view showing the terminal fitting.

Figure 8:
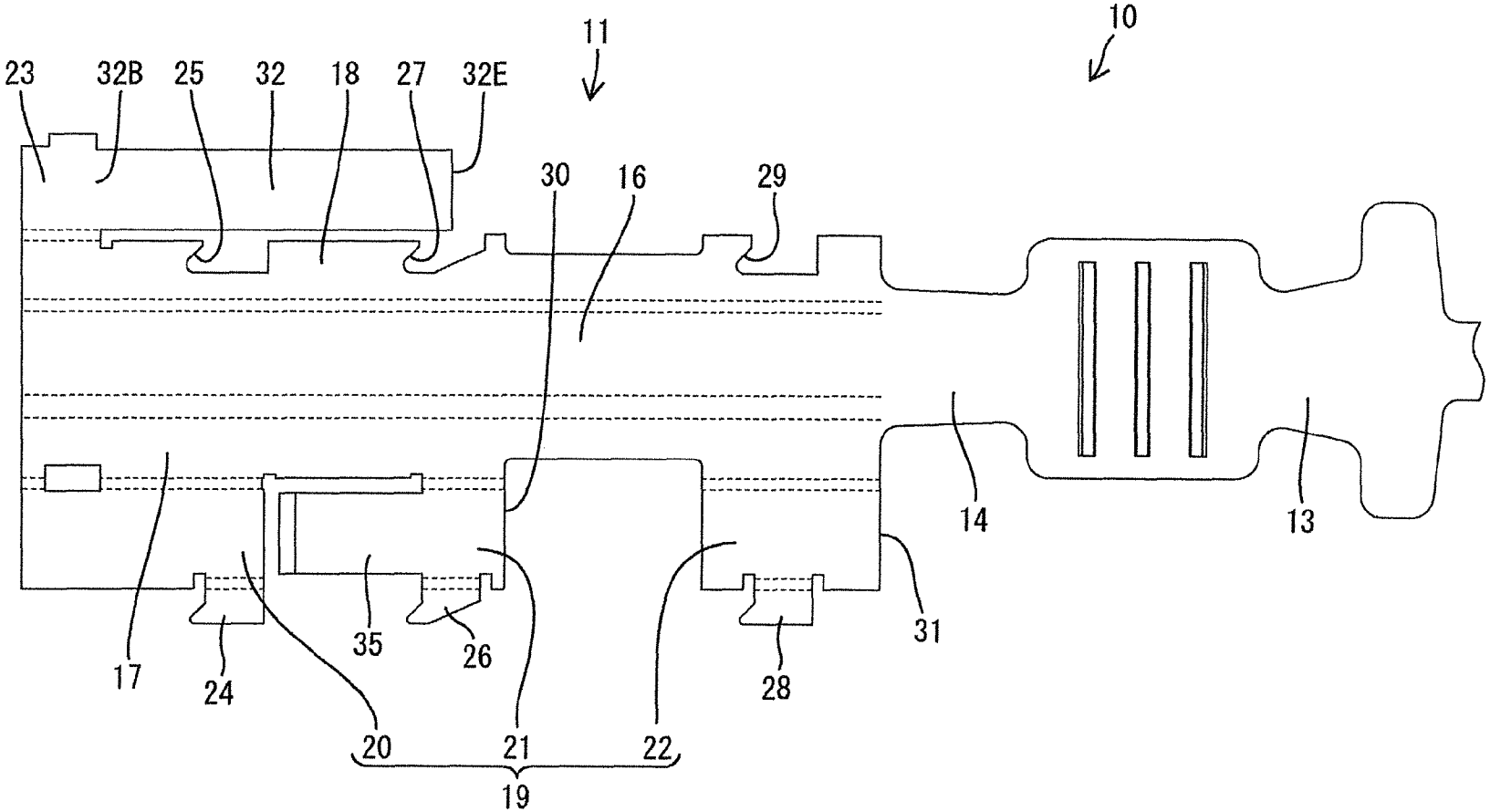

FIG. 8 is a developed view showing the terminal fitting.

Figure 9:
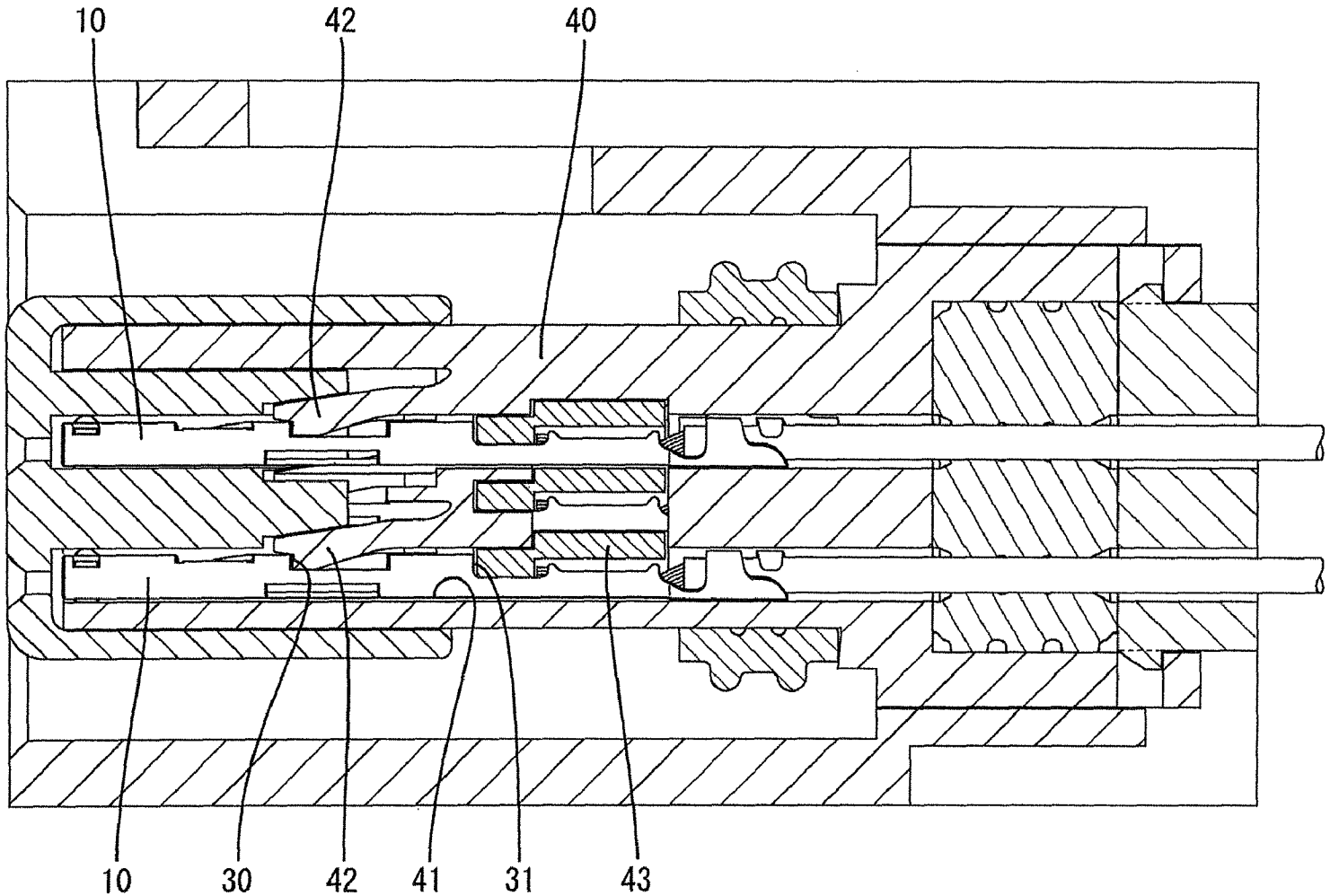

FIG. 9 is a sectional view showing a state in which the terminal fitting is inserted in a housing.

DETAILED DESCRIPTION OF THE PREFERRED EMBODIMENTS

A first embodiment according to the invention will be described below with reference to FIGS. 1 to 9. A terminal fitting 10 according to the embodiment is wholly a slender female terminal in a longitudinal direction (a parallel direction with a direction of a connection to a mating terminal 50). The terminal fitting 10 has a front end side part serving as a body portion 11 which accommodates an elastic contact piece 32 therein and takes substantially square tube shape rod, and a rear end side part serving as an open barrel-shaped electric wire connecting portion 13 for connecting an electric wire 12 through compression bonding. A rear end of the body portion 11 and a front end of the electric wire connecting portion 13 are linked to a box-shaped coupling portion 14 having an upper surface opened. An internal space of the body portion 11 which is provided under the elastic contact piece 32 serves as an inserting space 15 for inserting a tab 51 of the mating terminal 50 from a forward part of the body portion 11.

The body portion 11 is formed to take a shape of a square rod by linking a plurality of wall-shaped portions through a fold in a longitudinal direction. The wall-shaped portions are constituted by a lower surface wall 16, both of left and right side surface walls 17 and 18 which are erected (linked) from both of left and right side edges of the lower surface wall 16 at an almost right angle, and an upper surface wall 19 which is parallel with the lower surface wall 16. The upper surface wall 19 is constituted by a front wall 20 extended at an almost right angle from a front end of an upper edge (a rising edge) of the left side surface wall 17, a central wall 21 extended at an almost right angle from a rear position of the front wall 20 on the upper edge of the left side surface wall 17, a rear wall 22 extended at an almost right angle from a rear end of the left side surface wall 17, and a support wall 23 extended at an almost right angle from a front end of an upper edge of the right side surface wall 18.

A front holding piece 24 (a holding portion to be a constituent feature of the invention) having a forward protruded click portion is extended at an almost right angle from a rear end in a right side edge of the front wall 20. The front holding piece 24 is fitted in a front notch portion 25 of the right side surface wall 18. A central holding piece 26 (a holding portion to be the constituent feature of the invention) having a forward protruded click portion is extended at an almost right angle from a right side edge of the central wall 21. The central holding piece 26 is fitted in a central notch portion 27 of the right side surface wall 18. A rear holding piece 28 (a holding portion to be the constituent feature of the invention) having a forward protruded click portion is extended at an almost right angle from a right side edge of the rear wall 22. The rear holding piece 28 is fitted in a rear notch portion 29 of the right side surface wall 18.

Through the fitting of the three sets of longitudinal holding pieces 24, 26 and 28 in the notch portions 25, 27 and 29, there are controlled a relative displacement to open the front wall 20 and the right side surface wall 18, a relative displacement to open the central wall 21 and the right side surface wall 18, and a relative displacement to open the rear wall 22 and the right side surface wall 18. By the control of the relative displacement in the three places, the body portion 11 maintains the shape of the square rod.

A portion provided between the central wall 21 and the rear wall 22 in an external surface (an upper surface) of the body portion 11 serves as an engaging hole 30 opened to an outside of the body portion 11. The engaging hole 30 is taken away over a full width of the upper surface of the body portion 11, and furthermore, the upper edge portions of the right side surface wall 18 and the left side surface wall 17 are also taken away. As shown in FIG. 9, when the terminal fitting 10 is inserted in a cavity 41 of a housing 40 from a rear part, a lance 42 formed along an internal wall of the cavity 41 is engaged with the engaging hole 30 so that the terminal fitting 10 is prevented from slipping off.

A rear edge of the rear wall 22 in the body portion 11 serves as an engaging edge portion 31 facing an opening portion toward the upper surface side of the coupling portion 14. In a state in which the terminal fitting 10 is inserted in the cavity 41, a retainer 43 assembled into the housing 40 is engaged with the engaging edge portion 31. By the engaging action, the terminal fitting 10 is prevented from slipping off. In other words, the terminal fitting 10 is reliably prevented from slipping off by a double engaging action through the lance 42 and the retainer 43.

As shown in FIGS. 1 and 2, the elastic contact piece 32 takes such a configuration as to be extended like a cantilever rearward (rightward in FIG. 1) from the support wall 23, that is, in the same direction as a direction of an insertion of the tab 51 into the inserting space 15, and can be elastically displaced in a vertical direction (an intersecting direction with the direction of the insertion of the tab 51 into the inserting space 15) by setting, as a fulcrum, a base end 32B (a front end) linked to the support wall 23. A central part in a longitudinal direction (a direction of an insertion and pull-out of the tab 51) of the elastic contact piece 32 serves as a contact portion 33 to be contact means with the tab 51.

The elastic contact piece 32 is curved in such a manner that the contact portion 33 is placed in the lowest position (approaches the lower surface wall 16 most greatly) as seen from a side (a lateral direction which intersects with both the direction of the insertion of the tab 51 and a direction of the elastic displacement of the elastic contact piece 32). In other words, the elastic contact piece 32 is tilted to descend rearward from the base end 32B to the contact portion 33 and is tilted to ascend rearward from the contact portion 33 to an extended end 32E (a rear end). The elastic contact piece 32 is wholly curved to be bulged toward the inserting space 15.

The extended end 32E (an end on a front end side in the direction of the insertion of the tab 51) of the elastic contact piece 32 is provided in a corresponding position to the central wall 21 in the direction of the insertion and pull-out of the tab 51. In a state in which the tab 51 is not inserted into the inserting space 15, the elastic contact piece 32 is held without an elastic flexure in a retreating position shown in FIG. 2. At this time, the extended end 32E of the elastic contact piece 32 is provided in non-contact with the central wall 21. In a state in which the elastic contact piece 32 is placed in the retreating position, moreover, a spacing in a vertical direction (an almost parallel direction with a direction of a flexing piece of the elastic contact piece 32) between a receiving portion 34 formed on the lower surface wall 16 and protruded like a rib in a longitudinal direction and the contact portion 33 has a dimension which is slightly smaller than a thickness of the tab 51.

The body portion 11 is provided with an elastic reinforcing piece 35 as means for reinforcing an elastic force of the elastic contact piece 32 to raise a contact pressure between the tab 51 and the contact portion 33 as shown in FIGS. 1 and 2. The elastic reinforcing piece 35 is provided above the elastic contact piece 32, that is, on a vertical opposite side to the inserting space 15 with the elastic contact piece 32 interposed therebetween. The elastic reinforcing piece 35 takes such a configuration as to be extended like a cantilever forward (rearward in the direction of the insertion of the tab 51 into the inserting space 15) from the central wall 21 (that is, a wall-shaped portion which is different from the support wall 23 to which the elastic contact piece 32 is linked). In the direction of the insertion and pull-out of the tab 51, a direction of the extension of the elastic reinforcing piece 35 is opposite to that of the extension of the elastic contact piece 32.

A shape of the elastic reinforcing piece 35 seen from a side is tilted to descend from a base end 35B toward a forward extended end 35E (that is, over a full length of the elastic reinforcing piece 35). The extended end 35E (a front end) of the elastic reinforcing piece 35 is provided in a slightly forward position from the contact portion 33 (a rearward position in the direction of the insertion of the tab 51) in the vicinity of the contact portion 33 of the elastic contact piece 32 (that is, a position in a displaced region in a vertical direction of the elastic contact piece 32 in an elastic flexure of the elastic contact piece 32). Moreover, the extended end 32E of the elastic contact piece 32 is positioned in a slightly rear part (a front part in the direction of the insertion and pull-out of the tab 51) from the base end 35B of the elastic reinforcing piece 35.

In a state in which the tab 51 is not inserted into the inserting space 15, that is, the elastic contact piece 32 is not elastically flexed but held in the retreating position, the elastic reinforcing piece 35 is not elastically flexed but held in a waiting position shown in FIG. 2. In a state in which the elastic contact piece 32 is placed in the retreating position and the elastic reinforcing piece 35 is placed in the waiting position, the extended end 35E of the elastic reinforcing piece 35 does not come in contact with the contact portion 33 of the elastic contact piece 32 and the elastic reinforcing piece 35 never comes in contact with the elastic contact piece 32 over a full region thereof.

Moreover, an excessive flexure control portion 36 taking a downward bending configuration (toward the terminal connecting portion 32 side) is formed on a rear edge of the front wall 20. The excessive flexure control portion 36 is positioned in a forward part from a front end (the extended end 35E) of the elastic reinforcing piece 35. When the elastic contact piece 32 is displaced upward from the retreating position, a slightly forward part of the contact portion 33 in the elastic contact piece 32 abuts on the excessive flexure control portion 36 while the elastic flexure of the elastic contact piece 32 is in a range of an elasticity limit, and the elastic contact piece 32 is thus controlled so as not to be displaced upward any longer. Consequently, the elastic contact piece 32 can be prevented from causing a plastic deformation.

Next, the function of the embodiment will be described. When the tab 51 is inserted into the inserting space 15, a front end of the tab 51 abuts on the vicinity of the contact portion 33. Then, the tab 51 pushes up the elastic contact piece 32 with a progress of the insertion of the tab 51. Consequently, the elastic contact piece 32 is wholly displaced upward so that the extended end 32E of the elastic contact piece 32 abuts on a lower surface of the central wall 21. When the insertion of the tab 51 further progresses, thereafter, the elastic contact piece 32 is wholly flexed elastically to displace the contact portion 33 upward while changing a shape seen from a side thereof so that the tab 51 is brought into an interposing state between the contact portion 33 of the elastic contact piece 32 and the receiving portion 34.

While the tab 51 presses the elastic contact piece 32 upward to carry out an elastic displacement, moreover, the vicinal part of the contact portion 33 of the elastic contact piece 32 abuts on the extended end 35E of the elastic reinforcing piece 35 and presses the extended end 35E upward. By the pressing function of the elastic contact piece 32, the elastic reinforcing piece 35 is elastically flexed upward by setting the base end 35B as a fulcrum.

In a state in which the elastic contact piece 32 causes the extended end 32E to abut on the central wall 21, the elastic contact piece 32 is supported on the upper surface wall 19 in two longitudinal places (the base end 32B and the extended end 32E). As compared with the case in which a cantilever condition is maintained, therefore, an elastic force (an elastic restoring force) of the elastic contact piece 32 is increased. When the elastic reinforcing piece 35 is flexed elastically, moreover, the elastic restoring force of the elastic reinforcing piece 35 functions as a reactive force against the elastic contact piece 32. Consequently, the elastic force (the elastic restoring force) of the elastic contact piece 32 is correspondingly increased. Thus, the elastic restoring force of the elastic contact piece 32 is increased so that a contact pressure between the contact portion 33 and the tab 51 is raised. Therefore, a contact reliability between the tab 51 and the elastic contact piece 32 can be enhanced.

Furthermore, the elastic contact piece 32 takes an extending configuration in an almost identical direction to the direction of the insertion of the tab 51 into the inserting space 15. Therefore, there is no fear that the tab 51 might collide with the extended end 32E of the elastic contact piece 32 even if an inserting posture of the tab 51 into the inserting space 15 is inclined.

In addition, when the elastic contact piece 32 is flexed elastically, the extended end 35E of the elastic reinforcing piece 35 abuts on a vicinal position of the contact portion 33. Therefore, a displacement of the contact portion 33 is stabilized. Consequently, a contact pressure between the elastic contact piece 32 and the tab 51 is also stabilized.

By taking note of the configuration of the body portion 11 in which the wall-shaped portions are linked through an almost parallel fold with the direction of the insertion and pull-out of the tab 51, moreover, the upper surface wall 19 in the wall-shaped portions is provided with the holding portions (the front holding piece 24, the central holding piece 26 and the rear holding piece 28). They serve to control the relative displacement between the upper surface wall 19 and the right side surface wall 18 to hold the shape of the body portion 11 through an engagement with the right side surface wall 18. According to the structure, there is stabilized a quantity of the elastic flexure of the elastic contact piece 32 or the elastic reinforcing piece 35 in the insertion of the tab 51 into the inserting space 15. Consequently, the contact pressure between the tab 51 and the contact portion 33 (the elastic contact piece 32) is also stabilized.

In the embodiment, by taking note of the fact that the central wall 21 to which the base end 35B of the elastic reinforcing piece 35 is linked is positioned on the external surface side of the elastic contact piece 32, the central holding piece 26 is formed on the central wall 21 to which the elastic reinforcing piece 35 is linked. Consequently, the single central holding piece 26 can stabilize both the position of the base end 35B of the elastic reinforcing piece 35 and that of the extended end 32E of the elastic contact piece 32.

The invention is not restricted to the embodiment described with reference to the drawings but the following embodiments may be included in the technical range of the invention, for example.

(1) Although the extended end of the elastic contact piece is provided in non-contact with the wall-shaped portion in the state in which the tab does not abut on the elastic contact piece in the embodiment, the extended end of the elastic contact piece may come in contact with the wall-shaped portion in the state in which the tab does not abut on the elastic contact piece.

(2) Although the extended end of the elastic reinforcing piece is provided in non-contact with the elastic contact piece in the state in which the tab does not abut on the elastic contact piece in the embodiment, the extended end of the elastic control piece may come in contact with the elastic contact piece in the state in which the tab does not abut on the elastic contact piece.

(3) Although the extended end of the elastic reinforcing piece abuts on the position which is set forward apart from the contact portion in the elastic contact piece in the embodiment, the extended end of the elastic reinforcing piece may abut on a position which is set rearward apart from the contact portion in the elastic contact piece and may abut on the contact portion of a vicinal position thereof.

(4) Although the elastic reinforcing piece abuts on the elastic contact piece in only the extended end in the embodiment, the elastic reinforcing piece may have the other regions to abut on the elastic contact piece in addition to the extended end. In this case, an abutting configuration may be a point contact, a line contact or a face contact.

(5) Although the elastic contact piece takes such a configuration as to be extended like the cantilever in the rearward direction (the almost identical direction to the direction of the insertion of the tab) in the embodiment, the elastic contact piece may take such a configuration as to be extended like the cantilever in a forward direction. In this case, the elastic reinforcing piece may take such a configuration as to be extended like the cantilever in the forward or rearward direction.

(6) Although the direction of the extension of the elastic contact piece and that of the extension of the elastic reinforcing piece are opposite to each other in the embodiment, the direction of the extension of the elastic contact piece may be the same as that of the extension of the elastic reinforcing piece.

(7) Although there is employed the configuration in which the elastic contact piece and the elastic reinforcing piece are extended from the different wall-shaped portions from each other (the support wall and the central wall) in the embodiment, it is also possible to take a configuration in which the elastic contact piece and the elastic reinforcing piece are extended from an identical wall-shaped portion. More specifically, it is preferable to cause the elastic contact piece to take a configuration in which a plate-shaped portion extended from a front edge of the wall-shaped portion is folded back and to cut and erect a part of the same wall-shaped portion, thereby forming a terminal holding portion.

What is claimed is:

1. A terminal fitting comprising:

a body portion having a substantially square tube shape rod and having an inserting space for inserting a tab of a mating terminal therein;

an elastic contact piece provided to face the inserting space, having a configuration as to be extended like a cantilever in a direction of an insertion and pull-out of the tab with respect to the inserting space through a wall-shaped portion constituting the body portion, and having a contact portion to come in contact with the tab; and an elastic reinforcing piece provided on an opposite side to the inserting space with the elastic contact piece interposed therebetween, having a configuration as to be extended like a cantilever in the direction of the insertion and pull-out of the tab from the wall-shaped portion constituting the body portion, and having an extended end in proximity to in the contact portion of the elastic contact piece, wherein:

the elastic contact piece is elastically flexed through an abutment of the tab on the contact portion and the elastic reinforcing piece is elastically flexed through an abutment of the elastic contact piece flexed elastically in a state in which the tab is inserted in the inserting space;

an extended end of the elastic contact piece is provided in a slightly rear part from a base end of the elastic reinforcing piece with respect to the direction of the insertion of the tab;

the extended end of the elastic contact piece abuts on the wall-shaped portion constituting the body portion in a state in which the contact portion abuts on the tab; and the wall-shaped portion is constituted by a lower surface wall, both of left and right side surface walls which are erected from both of left and right side edges of the lower surface wall at an almost right angle, and an upper surface wall which is parallel with the lower surface wall, and the upper surface wall includes an excessive flexure control portion taking a downward bending configuration toward the elastic contact piece.

2. The terminal fitting according to claim 1, wherein the elastic contact piece has a configuration as to be extended in an almost identical direction to the direction of the insertion of the tab into the inserting space.

3. The terminal fitting according to claim 1, wherein the extended end of the elastic reinforcing piece is provided in a corresponding position to the contact portion or the vicinity thereof.

4. The terminal fitting according to claim 1, wherein the body portion has a configuration that a plurality of wall-shaped portions are linked through an almost parallel fold with the direction of the insertion and pull-out of the tab; and the wall-shaped portion is provided with a holding portion for restricting a relative displacement between the wall-shaped portions to hold the shape of the body portion through an engagement with another wall-shaped portion.

5. The terminal fitting according to claim 4, wherein:

a direction of an extension of the elastic contact piece and that of an extension of the elastic reinforcing piece are opposite to each other;

the extended end of the elastic contact piece abuts on the wall-shaped portion to which a base end of the elastic reinforcing piece is liked; and the holding portion is formed in the wall-shaped portion to which the base end of the elastic reinforcing piece is linked.

6. The terminal fitting according to claim 1, wherein the excessive flexure control portion is aligned substantially normal to the direction of the insertion and pull-out of the tab.

7. A terminal fitting having opposite front and rear ends and comprising:

a substantially rectangular tubular body adjacent the front end of the terminal fitting, the body having a lower wall, first and second side walls erected up from opposite sides of the lower wall and an upper wall extending from an upper end of the first side wall toward an upper end of the second side wall so that the upper and lower walls are substantially parallel;

an elastic contact piece cantilevered rearwardly into the rectangular tubular body from a position adjacent a part of the upper wall in proximity to the front end of the terminal fitting, the elastic contact piece having a contact for contacting a tab inserted into the tubular body between the elastic contact piece and the lower wall, the elastic contact piece further having an extended end that abuts on the upper wall when the contact of the elastic contact piece abuts the tab inserted into the rectangular tubular body;

an elastic reinforcing piece cantilevered forward from a location on the upper wall forward of the extended end of the elastic contact piece and disposed so that the elastic contact piece is between the elastic reinforcing piece and the lower wall of the rectangular tubular body; and an excessive flexure control portion bent down from a position on the upper wall forward of an extended end of the elastic reinforcing piece and toward the elastic contact piece.

8. The terminal fitting according to claim 7, wherein the extended end of the elastic reinforcing piece substantially aligns with the contact of the elastic contact piece.

9. The terminal fitting according to claim 7, further comprising a holding portion extending from an end of the upper wall remote from the first side wall and engaged with an upper end of the second side wall for restricting relative displacement between the upper wall and the second side wall.

* * * * *